United States Patent [19]

Siegman

[11] 4,226,817

[45] Oct. 7, 1980

[54] PURGING FOR SPINNING HYDRATED ACRYLIC POLYMER MELT

[75] Inventor: Edwin J. Siegman, Pensacola, Fla.

[73] Assignee: American Cyanamid Company, Stamford, Conn.

[21] Appl. No.: 12,977

[22] Filed: Feb. 21, 1979

[51] Int. Cl.[2] ..... B28B 7/04

[52] U.S. Cl. ..... 264/39; 264/206; 264/211

[58] Field of Search ..... 264/206, 169, 39; 260/29.6 AN, 29.6 AQ

[56] References Cited

U.S. PATENT DOCUMENTS

| | | | |
|---|---|---|---|
| 2,649,356 | 8/1953 | Bruson | 264/39 |
| 2,695,835 | 11/1954 | Hare | 264/210 F |
| 3,651,194 | 8/1972 | Bohrer | 269/39 |
| 3,707,588 | 12/1972 | Campbell et al. | 269/169 |
| 3,715,416 | 2/1973 | Campbell et al. | 264/169 |
| 3,896,204 | 7/1975 | Goodman et al. | 264/206 |

*Primary Examiner*—Jay H. Woo

*Attorney, Agent, or Firm*—Frank M. Van Riet

[57] ABSTRACT

An acrylonitrile polymer composition containing ethylene carbonate and optionally small amounts of water is an effective purge material for start-up and shut-down of melt spinning operations employing hydrated acrylonitrile polymer melts.

5 Claims, No Drawings

PURGING FOR SPINNING HYDRATED ACRYLIC POLYMER MELT

This invention relates to a composition useful in starting-up and shutting-down spinning operations in which a fusion melt of acrylonitrile polymer and water is spun into fiber. More particularly, this invention relates to such a composition comprising a copolymer of acrylonitrile, ethylene carbonate and, optionally, water.

Recent developments in the field of spinning acrylonitrile polymer fiber have led to melt-spinning procedures employing a fusion melt of acrylonitrile polymer and water. A fusion melt is a composition comprising water and acrylonitrile polymer at a temperature and pressure sufficient to provide a melt of the polymer and water associated therewith. The melt temperature is above the boiling point of water at atmospheric pressure and below the normal deterioration or melting point of the polymer. It is at a pressure above atmospheric pressure so as to maintain water in liquid state, usually above autogeneous pressure. When the composition melted contains the proper proportions of polymer and water, a homogeneous single-phase fusion melt arises and this is the preferred composition for spinning. In the case of a homogeneous single-phase fusion melt, water will generally constitute from about 5 to 30 weight percent of the total composition.

In the usual manner of conducting the melt-spinning process, the polymer and water are fed to a screw-extruder where they are compacted and melted to form filamentary extrudates. Although the process operates in continuous manner at steady state, it is difficult to achieve steady state because of the presence of water in the fusion melt. Thus starting with empty equipment, the presence of water in the fusion melt, which is at a temperature above the boiling point of water at atmospheric pressure, would tend to cause water volatilizing from the melt and escaping through forward openings in the equipment through which the fusion melt is to pass. As a result of this loss of water, the advancing portion of the fusion melt will solidify and interfere with start-up of the processing. Conversely, when the spinning operation is shut down, the melt will solidify upon cooling and water will evaporate therefrom. Subsequently applied heat will not melt the polymer left in the equipment because of the reduced water content and start-up will be difficult. Because of these difficulties it has been difficult to effect start-up of such spinning process and normal shut-down requires complete dismantling of the equipment and clean-out thereof in order to start processing again.

What is needed, therefore, is a start-up and shut-down composition which can be entered into the processing equipment and left therein upon shutting down processing, or as a forerun in processing, so that effective start-ups using fusion melts can be readily effected. The provision for such a composition would fulfill a long-felt need and constitute a significant advance in the art.

In accordance with the present invention there is provided a purge composition for use in conjunction with melt-spinning a fusion melt of acrylonitrile polymer and water which comprises from about 65 to about 85 weight percent of an acrylonitrile copolymer, from about 15 to 35 weight percent of ethylene carbonate, and from 0 to about 5 weight percent of water, said purge being in solid state at a temperature below about 40° C. and atmospheric pressure and having a melt viscosity which is about equal to, or greater than, the fusion melt to be purged or entered at the melting temperature of said fusion melt, the quantity of purge composition employed being sufficient to fill the processing areas of said compacting zone and said spinneret assembly.

The present invention enables start-up of the fusion melt spinning procedure to be readily effected when properly shut-down. In normal shut-down, it is only necessary to purge the fiber-spinning composition from the spinning equipment with the specified purge composition and then cease operations. When start-up is desired, it is only necessary to purge the purge composition from the spinning composition with fiber-forming composition and commence operations. Since the purge composition contains a powerful polymer solvent, the purge composition readily penetrates into the fiber-forming composition and vice versa so as to effect the necessary removal of composition from the spinning equipment.

As indicated, the purge composition will contain from about 65 to 85 weight percent of an acrylonitrile copolymer. A copolymer is employed instead of a homopolymer of acrylonitrile because most of the acrylonitrile polymers melt spun are copolymers and a copolymer offers more flexibility in melt viscosity, operating temperatures, and the like so as to be widely applicable. Such a copolymer preferably will contain from about 80 to 99 weight percent of acrylonitrile and from about 1 to 20 weight percent of one or more monomers copolymerizable with acrylonitrile. It may be convenient to use the same polymer as is to be melt spun as the copolymer of the purge composition. Alternatively, the purge copolymer may be a reprocessed polymer or off-grade polymer not desirable for fiber use. As indicated, the polymer, when formulated with solvent and optional water content, should have a melt viscosity about equal to that of the polymer used to prepare fiber or a viscosity that is higher than that used to prepare fiber. Variations in the content of ethylene carbonate and water in the purge composition will enable the proper melt viscosities to match those of the spinning compositions.

The purge composition will also contain from about 15 to 35 weight percent of ethylene carbonate (preferably about 20 to 30 weight percent ) which is a powerful solvent for the polymer. At temperatures below about 40° C. and atmospheric pressure, the ethylene carbonate will be completely adsorbed by the polymer and a solid composition will result. However, as this composition is heated in conjunction with compacting, it will provide a melt. Since the boiling point of ethylene carbonate is high enough to remain in liquid state at the melt temperature developed, there is little tendency for ethylene carbonate to evaporate as processing is conducted at the normal melt temperature of the polymer-water composition.

Water is an optional component of the purge composition and generally arises as moisture content of the polymer powder. The water content should be in the range of 0 to 10 weight percent of the purge composition. As indicated above, water may be added to control the melt viscosity of the purge composition within the water content specified.

The purge composition is preferably prepared by dry blending the various components and drying the mixture in air. The resulting composition is then fed to the compacting zone and processed through the equipment employed.

The invention is more fully illustrated in the examples which follow wherein all parts and percentages are by weight unless otherwise specified.

EXAMPLE 1

PURGE COMPOSITION PREPARATION

Purge polymer was prepared by dry blending a copolymer of 89% AN and 11% MMA with $M_k$=48,000 with granulated solid ethylene carbonate (EC). After drying in air the resulting composition was approximately 70% copolymer, 25% EC, and 5% $H_2O$. The material was a slightly rubbery solid which was easily granulated to approximately ⅛" particles.

EXAMPLE 2

SHUT-DOWN OPERATION

A ¾" extruder supplying melt to spinneret through a pump was operating with copolymer of 89% AN and 11% MMA, was stopped and purge polymer composition of Example 1 was fed to the extruder. The purge material was fed until the melt exiting the spinneret was clear and visibly free of "run" polymer. Feeding of purge polymer was stopped, and the heat burned off on the extruder and spinning equipment.

EXAMPLE 3

START-UP OPERATION

The following day, the equipment was reheated and additional purge polymer fed through the extruder and spinning equipment. "Run" polymer was then fed to the extruder and after displacing the purge polymer melt from the system, fiber spinning was resumed. Spinning performance was fully equal to the previous day in all respects.

I claim:

1. In the process of melt-spinning acrylonitrile polymer fiber which comprises furnishing a composition of acrylonitrile polymer and water in solid form to a compacting zone, converting said polymer and water composition to a homogeneous single-phase fusion melt while in said compacting zone, and extruding the resulting fusion melt through a spinnerette assembly, the improvement which comprises adding a purge composition prior to or subsequent to said furnishing of said polymer-water composition, said purge composition comprising from about 65 to 85 weight percent of an acrylonitrile copolymer, from about 15 to 35 weight percent of ethylene carbonate, and from 0 to about 5 weight percent of water, said purge being in solid state at a temperature below about 40° C. and atmospheric pressure and having a melt viscosity which is about equal to or greater than that of the fusion melt to be purged or extruded at the melting temperature of said fusion melt, the quantity of purge composition employed being sufficient to fill the processing areas of said compacting zone and said spinnerette assembly.

2. The process of claim 1 wherein said copolymer contains from about 80 to 99 weight percent of acrylonitrile and from about 1 to 20 weight percent of one or more monomers copolymerizable with acrylonitrile.

3. The process of claim 1 wherein said ethylene carbonate is present in the amount of about 20 to 30 weight percent.

4. The process of claim 1 wherein said water is omitted.

5. The process of claim 1 wherein said copolymer contains about 85 to 95 weight percent acrylonitrile and about 5 to 15 weight percent methyl methacrylate.

* * * * *